US006540566B1

(12) United States Patent
Wu

(10) Patent No.: US 6,540,566 B1
(45) Date of Patent: Apr. 1, 2003

(54) ELECTRICAL CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/066,052

(22) Filed: Jan. 31, 2002

(51) Int. Cl.[7] ..... H01R 13/40
(52) U.S. Cl. ..... 439/733.1; 439/79
(58) Field of Search ..... 439/733.1, 79, 439/752

(56) References Cited

U.S. PATENT DOCUMENTS 5,040,998 A * 8/1991 Suzuki et al. ..... 333/246
5,464,356 A * 11/1995 Nebeshima et al. ..... 439/733.1
6,045,408 A * 4/2000 Takemasa ..... 439/660
6,165,027 A * 12/2000 Huang et al. ..... 439/733.1

* cited by examiner

*Primary Examiner*—Tho D. Ta
(74) *Attorney, Agent, or Firm*—Wei Te Chung

(57) ABSTRACT

A connector includes an insulative housing defining a plurality of passageways for receiving pins therein. A buffering slot is defined in the housing corresponding to and adjacent each passageway. When pins are forcibly fit into the passageways, deformation is caused on the flexible walls for absorbing the stress/strain induced in the housing. The deformation of the flexible walls are accommodated by the corresponding buffering slots.

10 Claims, 3 Drawing Sheets

ELECTRICAL CONNECTOR

BACKGROUND OF THE INVENTION

1. Field of the Invention

The present invention relates to an electrical connector, and more particularly to a header connector having buffering slots.

2. Description of the Related Arts

A header connector is electrically connected with and securely mounted on a printed circuit board (PCB) for electrically and releasably engaging a mating connector for transmission of electrical signals therebetween. The header connector generally has an insulative housing retaining a number of pins that forms electrical paths between the mating connector and the PCB. One way to make the header connector is to form the insulative housing first with a plurality of passageways defined therein; the pins are then forcible inserted into the passageways forming a tight fit therebetween. However the force fit engagement between the pins and the housing may induce excessive stress/strain and thus causing damage to the housing, especially when the total number of pins is great, for example 48 pins.

SUMMARY OF THE INVENTION

In view of the above, an object of the present invention is to provide a header connector comprising a housing structured to absorb excessive stress/strain produced by force fit engagement between pins and passageways of the housing.

To attain the object, a header connector in accordance with the present invention comprises an insulative housing having a base defining a plurality of passageways for receiving pins therein. The housing further defines a buffering slot adjacent each passageway forming a flexible wall between each buffering slot and the passageway. When the pins are forcibly fit into the passageways, stress induced in the housing is eliminated by deflection of the flexible walls into the buffering slots. Accumulation of stress in the housing is thus avoided, and the housing will not be damaged by the accumulative stress.

Other objects and advantages of the present invention will be understood from the following description of a preferred embodiment of the present invention, with reference to accompanying drawings, wherein:

BRIEF DESCRIPTION OF THE INVENTION

DETAILED DESCRIPTION OF PREFERRED EMBODIMENT

Figure 1:
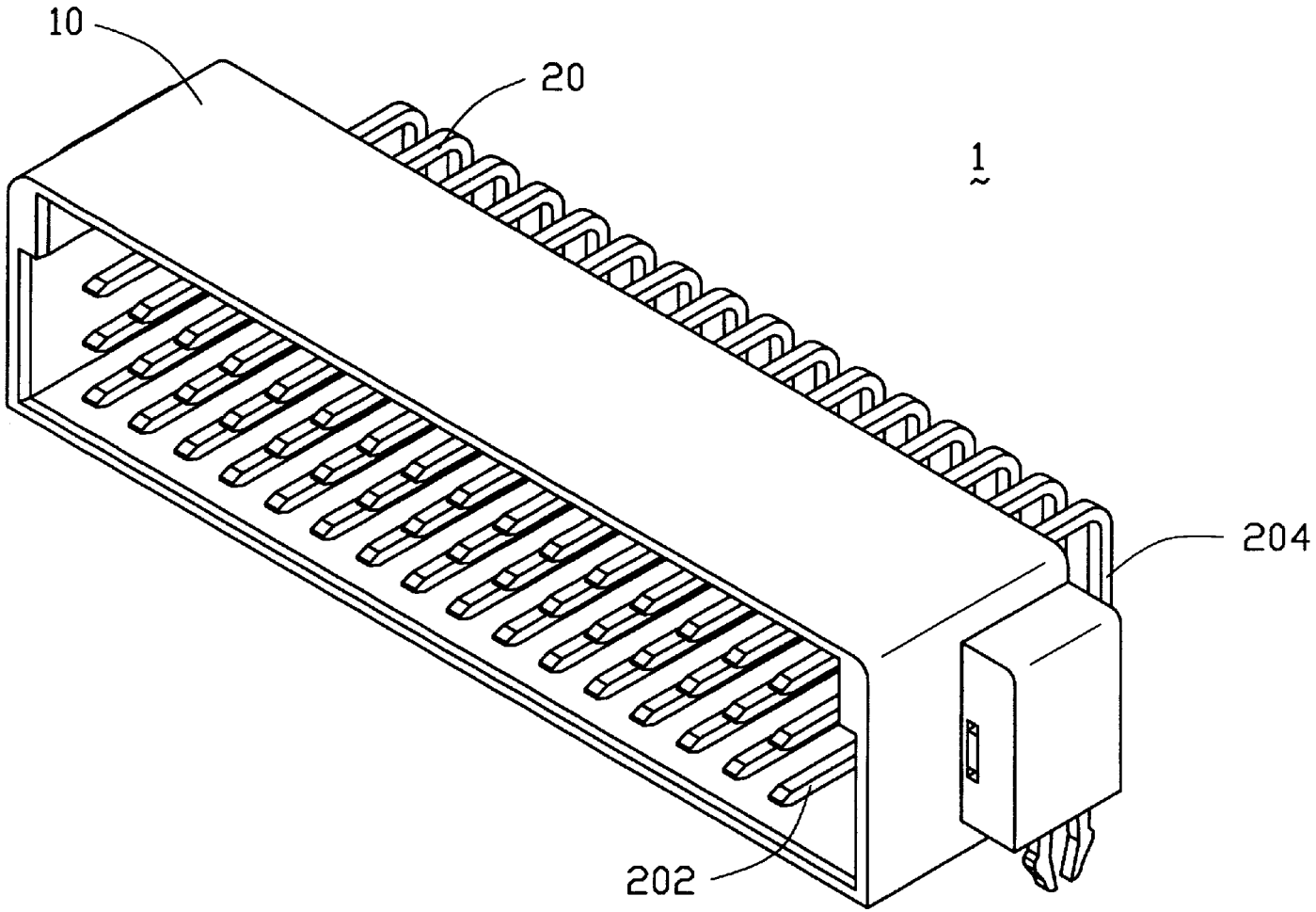
FIG. 1 is a perspective view of a header connector according to the present invention.
Figure 2:
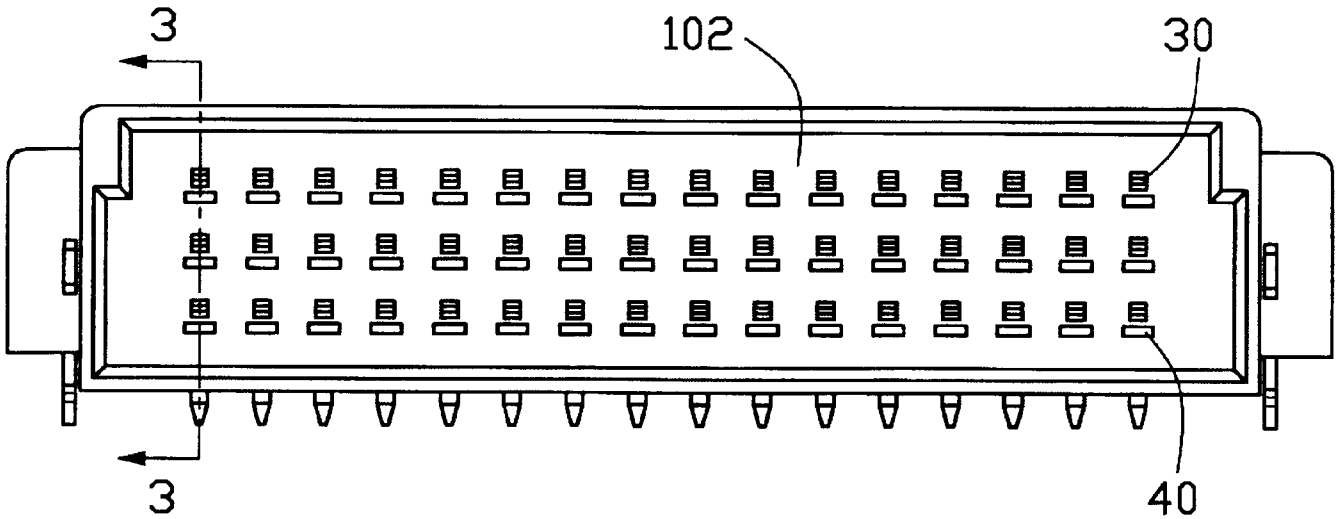
FIG. 2 is a top plan view of the head connector according to the present invention.
Figure 3:
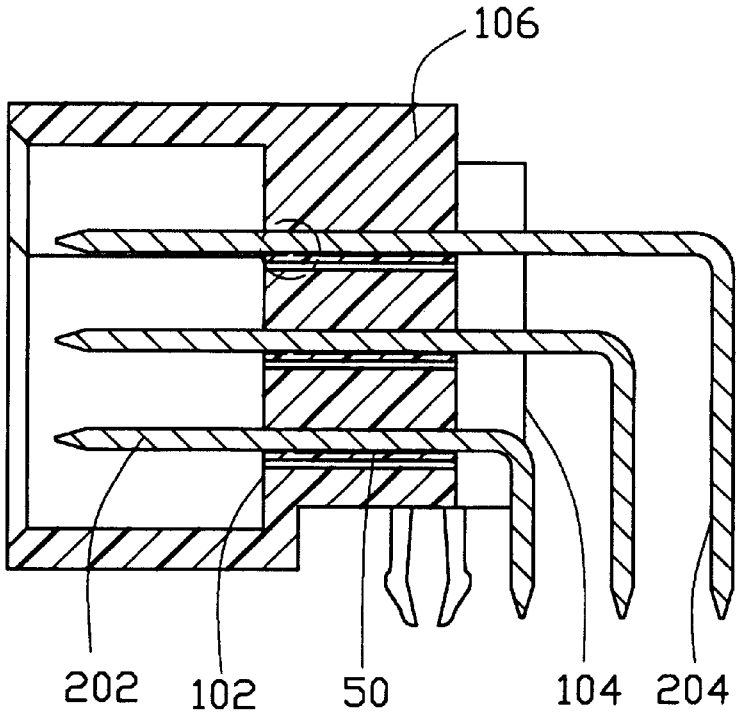
FIG. 3 is a cross-sectional view taken along line 3—3 of FIG. 2.

Referring to FIGS. 1–3, a head connector 1 comprises an insulative housing 10 having a base 106 defining three rows of passageways 30 therethrough for receiving and retaining conductive pins 20 therein. In the embodiment illustrated, the rows of passageways 30 are substantially parallel to each other. A buffering slot 40 is formed adjacent to each passageway 30 forming a flexible wall 50 between the buffering slot 40 and the passageway 30. Preferably, the distance between each passageway 30 and the corresponding buffering slot 40 is equal. That is the flexible walls 50 have substantially equal thickness between each buffering slot 40 and the corresponding passageway 30.

In the embodiment illustrated, the buffering slot 40 is nearly cuboids, having a depth between 50% and 100% of depth of the base 106. Preferably the depth of the buffering slot 40 is around ⅔ of the depth of the base 106. Further, the length of the opening of the buffering slot 40 in a front surface 102 of the base 106 is greater than the length of the opening of the passageway 20 in the front surface 102 of the base 106 in order to ensure maximum flexibility of the wall 50.

Figure 4:
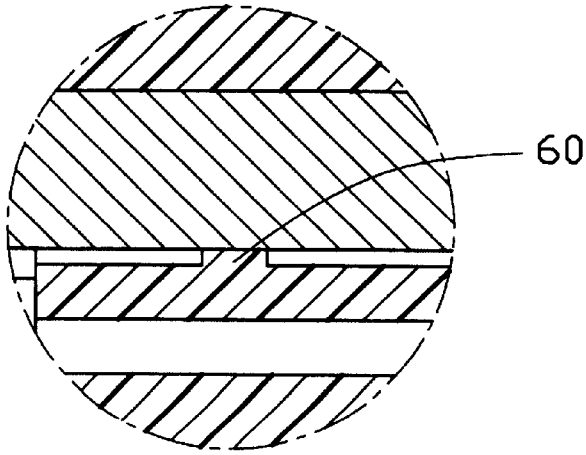
FIG. 4 is an enlarged view of encircled portion of FIG. 3.

Also referring to FIG. 4, a projection 60 is formed on an inside surface of each passageway 30 for securely retaining the pin 20 in the passageway 30.

Each pin 20 comprises a connection portion 202 perpendicularly extending beyond the front surface 102 of the base 106 and a tail portion 204 extending beyond the rear surface 104 of the base 106 and in a direction substantially parallel to the rear surface 104.

When the pins 20 are inserted into the passageways 30, the flexible walls 50 are elastically deformed, absorbing the stress/strain induced in the housing 10 by the force fit engagement and the deflection of the walls 50 is accommodated in the corresponding buffering slots 40. In this way, the stress is not accumulated, and damage caused by excessive stress is avoided.

Although the present invention has been described with reference to the preferred embodiment thereof, it is apparent that the invention can be modified by those skilled in the art without departing from the scope of the invention. These modifications may nonetheless fall within the spirit and scope of the present invention defined in the following claims.

What is claimed is:

1. A connector comprising:

an insulative housing defining a plurality of passageways and a plurality of buffering slots adjacent the passageways, each buffering slot being in association with at least one passageway with a flexible wall formed therebetween, and said each buffering slot being not communicated with the at least one passageway; and a pin forcibly fit and thus retained in each passageway with the flexible wall being at least partially deformed into the buffering slot.

2. The connector according to claim 1, wherein each individual buffering slot is corresponding to one of the passageways.

3. The connector according to claim 1, wherein the buffering slots are cuboids.

4. The connector according to claim 1, wherein the insulative housing includes a base defining the plurality of passageways and the plurality of buffering slots adjacent the passageways, and wherein the buffering slots have a depth between 50 and 100 percent of a depth of the base.

5. The connector according to claim 1, wherein the buffering slots have a length greater than length of the passageways.

6. The connector according to claim 1, wherein a projection is formed on an inside surface of each passageway for securely retaining the pin.

7. A header connector comprising:

a housing defining a plurality of passageways and a plurality of buffering slots, each buffering slot corresponding to and adjacent one of the passageways to form a flexible wall therebetween and not communicated with the one of the passageways; and a plurality of pins forcibly fit and thus retained in the corresponding passageways with the flexible walls being deformed into corresponding buffering slots.

8. An electrical connector comprising:

an insulative housing;

a plurality of passageways formed in said housing and extending in a first direction thereof;

a plurality of buffering slots closely but not communicatively formed beside said passageways, respectively, in a one-by-one relation thereof, said buffering slots extending in said first direction; and a plurality of pins forcibly inserted into corresponding passageways, respectively; wherein said buffering slots provide spaces to forgive deformation, generated by the corresponding pins, of the housing around the corresponding passageways, respectively.

9. The connector according to claim 8, wherein said housing defines a lengthwise direction along a longer dimension thereof and a lateral direction, perpendicular to said lengthwise direction, along a shorter dimension thereof, and said buffering slots are located beside the corresponding passageways, respectively, in the lateral direction.

10. The connector according to claim 9, wherein all the buffering slots are located beside the corresponding passageways, respectively, in commonly a second direction perpendicular to said first direction.

* * * * *